US006000818A

United States Patent [19]

Caluori

[11] Patent Number: 6,000,818

[45] Date of Patent: Dec. 14, 1999

[54] MOUNTING CLIP FOR A RECESSED LIGHT FIXTURE

[75] Inventor: Giuseppe Caluori, Dollard-des-Ormeaux, Canada

[73] Assignee: Canlyte Inc., Lachine, Canada

[21] Appl. No.: 09/174,319

[22] Filed: Oct. 19, 1998

[51] Int. Cl.[6] ..... F21S 1/02

[52] U.S. Cl. ..... 362/365; 362/147; 362/364

[58] Field of Search ..... 362/147, 364, 362/365, 366, 396, 404

[56] References Cited

U.S. PATENT DOCUMENTS 4,274,615 6/1981 Chan et al. ..... 362/365

5,236,157 8/1993 Reggiani ..... 362/366

5,725,302 3/1998 Sirkin ..... 362/365

*Primary Examiner*—Y. Quach

*Attorney, Agent, or Firm*—Dimock Stratton Clarizio; Mark B. Eisen

[57] ABSTRACT

A clip for mounting a recessed light fixture into a panel includes a clamping assembly for anchoring the clip to a hole in the panel, and a resilient arm biased toward a housing of the light fixture which frictionally engages the housing to support the fixture in the panel. In the preferred embodiment a gripping edge of the resilient arm contacts the housing at an oblique angle, so that turning the housing in a particular direction draws the fixture into the hole and thus draws a flange surrounding the mouth of the housing flush against the panel.

31 Claims, 3 Drawing Sheets

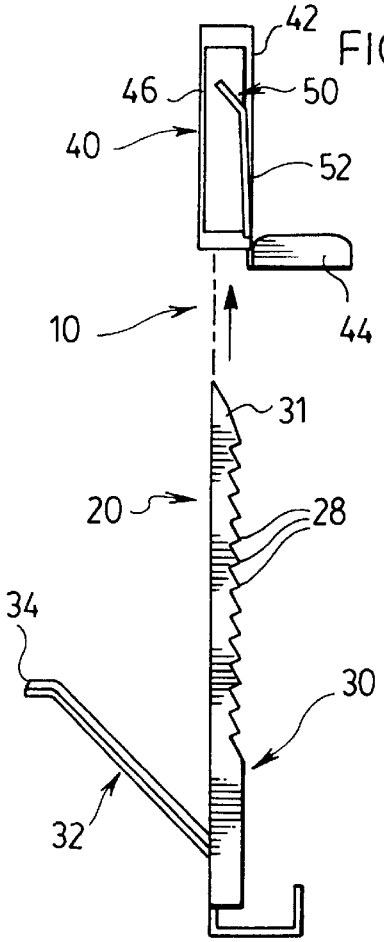
FIG.3.
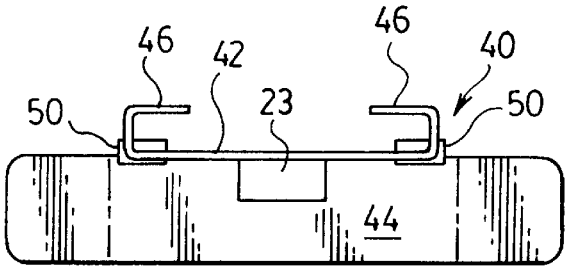
FIG.4.
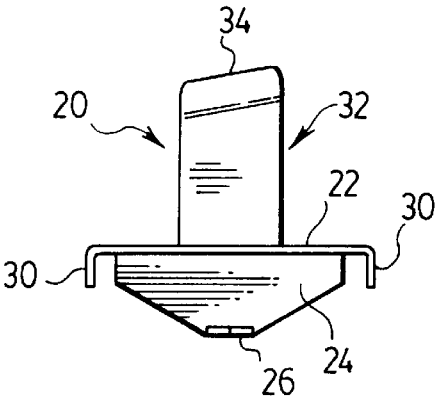
FIG.5.
FIG.6.
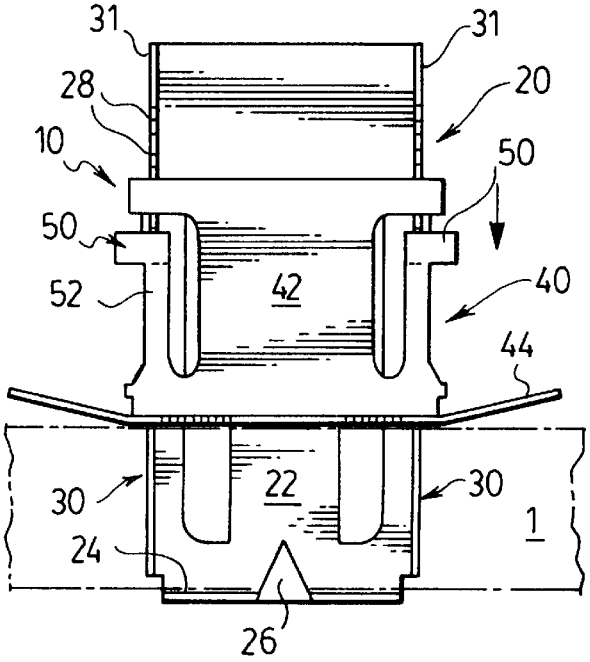

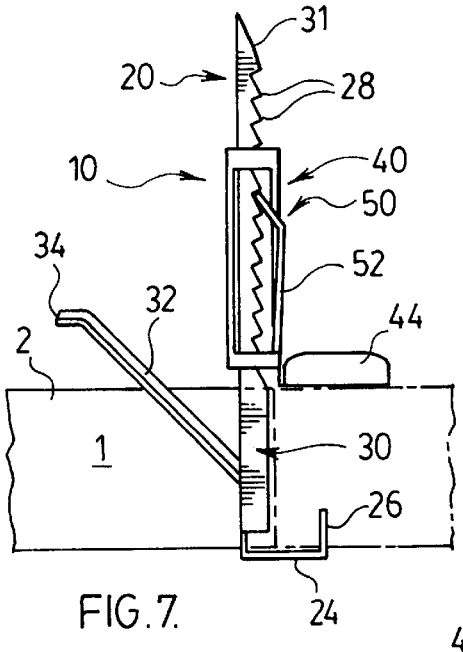
FIG. 7.
FIG. 8.
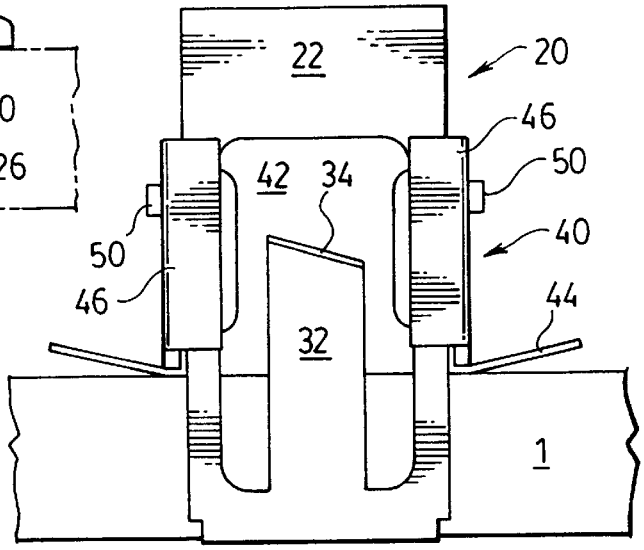
FIG. 9.
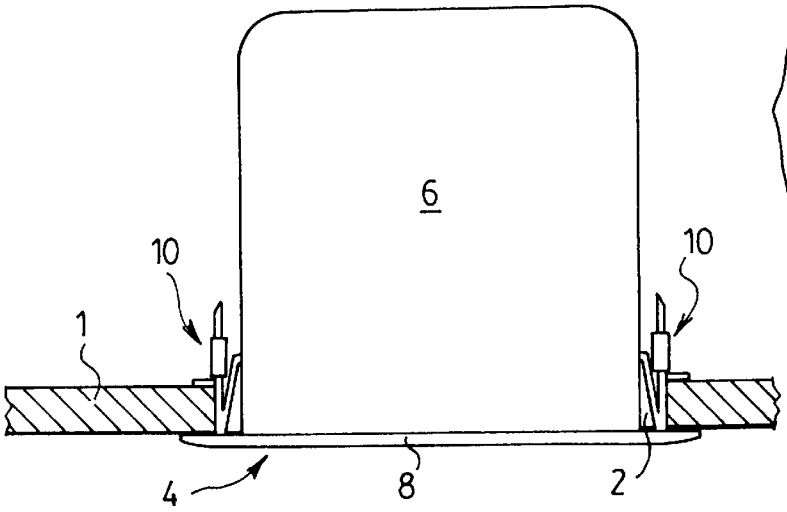
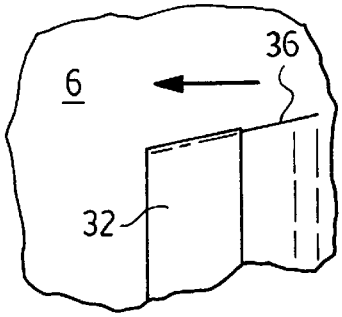
FIG. 10.

MOUNTING CLIP FOR A RECESSED LIGHT FIXTURE

FIELD OF INVENTION

This invention relates to light fixtures. In particular, this invention relates to a mounting clip for securing a recessed light fixture to a ceiling.

BACKGROUND OF THE INVENTION

Recessed light fixtures known as "pot lights" are in widespread use in residential and commercial premises. They appeal to designers because they take up virtually no space in a room, being recessed into a ceiling or wall, and for their aesthetic versatility and appeal.

A typical recessed light fixture comprises a cylindrical housing, which is usually composed of aluminum, terminating in a housing flange flaring out from the mouth of the housing to cover the ceiling hole. The housing contains a socket for a floodlight, halogen bulb or other electric lamp, which is engaged to the socket through the mouth of the fixture.

Conventionally, to mount such a light fixture a hole is cut in the ceiling and a mounting ring is inserted which engages the fixture. The mounting ring engages the hole in an interference fit, with a flange that abuts the exposed face of the ceiling and a spring, flexible arm or other structure which retains the mounting ring in the hole. The hole in the ceiling must be precisely cut to match the size and shape of mounting ring, otherwise the ring will not properly engage the hole and the fixture will not be securely mounted. This can be a time consuming process where a number of fixtures are to be installed. Further, since even a properly mounted ring will usually experience some degree of motion in the hole when pressure is applied, it is difficult to press the fixture entirely into the hole to the point where the housing flange snugly abuts the ceiling; once the pressure is released the mounting ring settles back to a rest position in the hole and a small space is usually left between the ceiling and the housing flange, which detracts from the aesthetic appeal of the fixture.

It would thus be advantageous to provide a means for mounting such a recessed light fixture which requires less precision in cutting a hole in the panel for the fixture while still ensuring a secure mounting of the fixture. It would further be advantageous to provide a means for mounting such a recessed light fixture so that the housing flange rests flush against the supporting panel.

The present invention overcomes these problems by providing a mounting clip for engaging the periphery of the hole, having a resilient arm which extends into the space occupied by the housing of the fixture and frictionally engages the housing. In the preferred embodiment a gripping edge of the resilient arm engages the housing of the fixture at an oblique angle relative to the panel; thus, the fixture can be substantially depressed into the ceiling hole, and by turning the housing in one direction the gripping edge of the resilient arm etches into the housing at a pitch which effectively allows the housing to be "screwed" into the hole until the housing flange rests flush against the panel. A plurality of clips distributed about the hole in the panel thus securely supports the light fixture flush mounted to the panel.

In the preferred embodiment the mounting clip comprises an anchoring member and a clamping member which are adjustable relative to one another, so that the clip can be secured to ceilings of different thicknesses, the supporting panel being essentially clamped between the anchoring member and the clamping member. To mount a recessed light fixture into a panel using the clip of the invention requires no additional hardware or supporting structure. All that is required is hole for the fixture in the supporting panel. This results in a substantial savings in labour and material costs.

The present invention thus provides a clip for mounting a recessed light fixture having a housing with a flange disposed about a mouth of the housing into a hole in a supporting panel, comprising an anchoring member having a floor, a clamping member slidably engaged to the anchoring member by sliding the clamping member along the anchoring member in a clamping direction, having a foot disposed in opposition to the floor, a fixing element for fixing the clamping member to a selected position along the anchoring member, and a resilient arm extending into a space to be occupied by the housing, wherein when a clip is affixed about the hole in the panel, as the fixture is inserted into the hole the resilient arm frictionally engages against the housing to mount the fixture to the panel.

The invention further provides a clip for mounting a recessed light fixture having a cylindrical housing with a flange disposed about a mouth of the housing into a hole in a supporting panel, comprising an anchoring assembly for engaging the clip to a periphery of the hole, and a resilient arm comprising a gripping edge impinging into a space to be occupied by the housing, wherein when the fixture is disposed in the hole the gripping edge frictionally engages the housing to mount the fixture into the panel.

The invention further provides, in combination, a recessed light fixture having a housing with a flange disposed about a mouth of the housing, and a clip for mounting the light fixture into a hole in a supporting panel, the clip comprising an anchoring assembly for engaging the clip to a periphery of the hole and a resilient arm comprising a gripping edge impinging into a space to be occupied by the housing, wherein when the fixture is disposed in the hole the gripping edge frictionally engages the housing to mount the fixture into the panel.

BRIEF DESCRIPTION OF THE DRAWINGS

In drawings which illustrate by way of example only a preferred embodiment of the invention, FIG. 3 is an exploded side elevation of the clip of FIG. 1, FIG. 4 is a top plan view of the anchoring member, FIG. 5 is a top plan view of the clamping member, FIG. 6 is a rear elevation of the clip of FIG. 1 engaged to a supporting panel, FIG. 7 is a front elevation of the clip of FIG. 6, FIG. 8 is a rear elevation of the clip of FIG. 6, FIG. 9 is a side elevation of a light fixture mounted using the clip of the invention, and FIG. 10 is an enlarged partial elevation showing the clip engaging the housing of the light fixture.

DETAILED DESCRIPTION OF THE INVENTION

Figure 1:
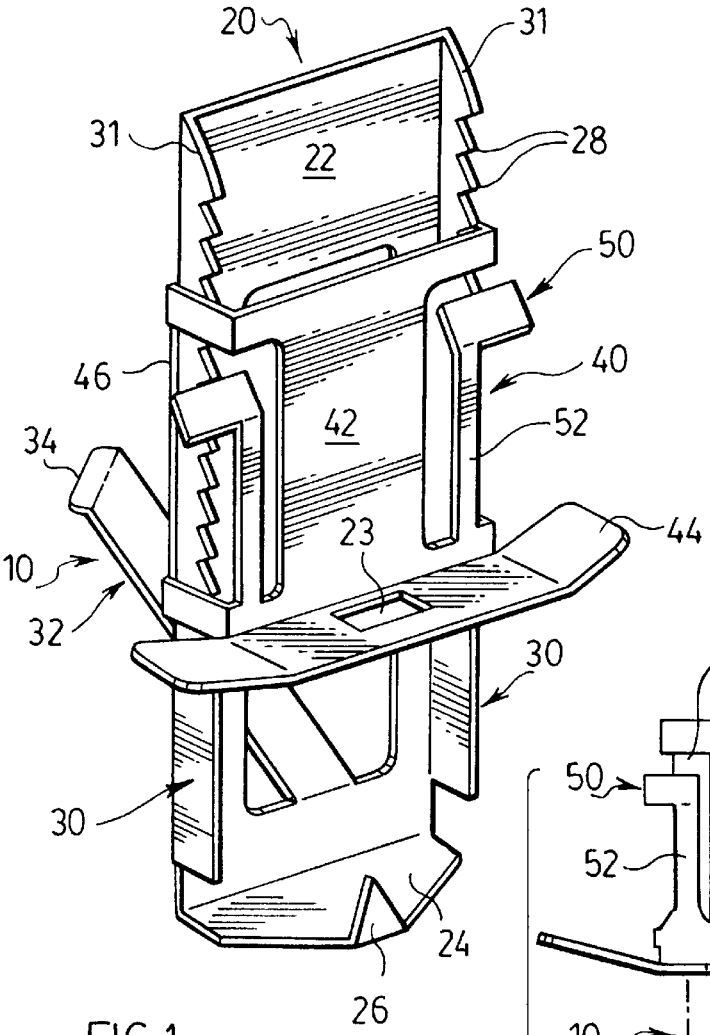
FIG. 1 is a perspective view of the mounting clip.

The invention comprises a clip 10, a preferred embodiment of which is illustrated in FIGS. 2 to 9, for mounting a recessed light fixture 4 such as a pot light having a housing 6 containing an electrical socket for an electric lamp (not shown), for example an incandescent floodlight or halogen lamp. The housing 6 is typically cylindrical and has an open mouth surrounded by a flange 8, which conceals a hole 2 in the panel 1 into which the fixture 4 is mounted. The supporting panel 1 may be a ceiling or wall panel (of wall board, wood, plaster etc.), or any other panel including for example an aluminum panel in a soffit. The clip 10 of the invention, described below, is adaptable to all such mounting surfaces 1.

Figure 2:
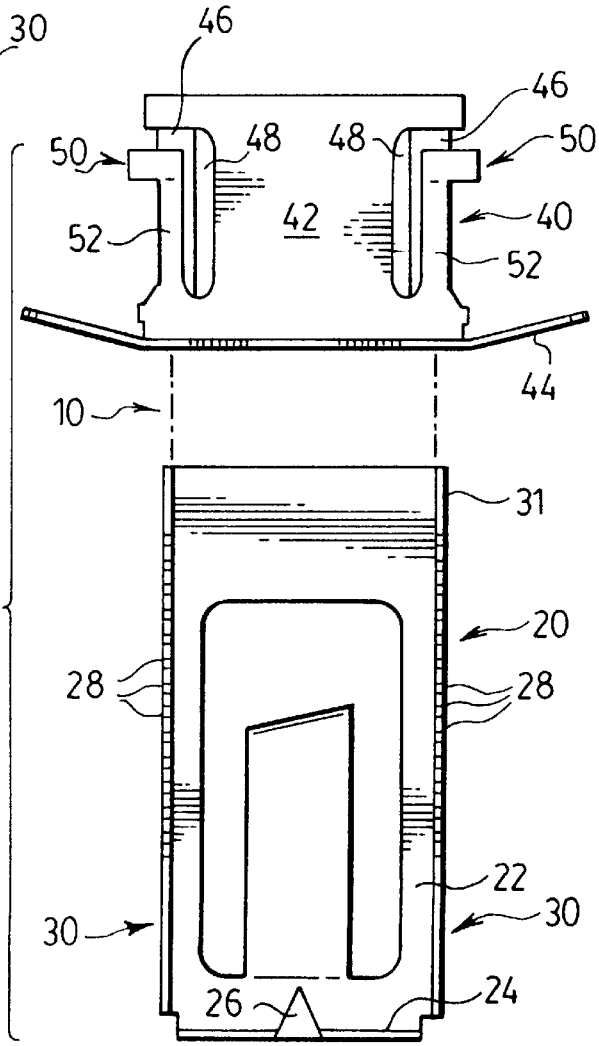
FIG. 2 is an exploded rear elevation of the clip of FIG. 1.

The clip 10 is mounted to the periphery of the hole 2 in the panel 1 by an anchoring assembly. As shown in FIGS. 2 and 3, in the preferred embodiment the anchoring assembly comprises an anchoring member 20 and a clamping member 40 which cooperate to form a clamp. The periphery of the hole 2 in the panel 1 seats against the anchoring member 20, and the clamping member 40 is fixed to the anchoring member 20 with the panel 1 clamped therebetween. The clip 10 is preferably die cut or stamped from a strong, resilient material such as hardened spring steel.

In the preferred embodiment the anchoring member 20 comprises a body 22 preferably formed integrally with a floor 24 having an upwardly projecting tooth 26 which penetrates the exposed face of the panel 1 and helps to anchor the clip 10. The tooth 26 is pointed and thus able to penetrate most common panel materials, including plaster, wood and aluminum.

The upper portion of the anchoring member 20 is provided with a series of ratchet teeth 28 which serve to fix the clamping member 40 at a selected position on the anchoring member 20. Preferably the ratchet teeth 28 are disposed along wings 30 bent along the sides of the body 22, and the upper end 31 of each wing 30 is preferably tapered to facilitate insertion into the clamping member 40.

The clamping member 40 comprises a body 42 preferably formed integrally with a foot 44, an arm 46 extending along a portion of each side of the body 42 for trapping the upper portion of the anchoring member 20, and a fixing element, in the preferred embodiment comprising a pawl 50 having a resilient stem 52. The pawl 50 cooperates with the ratchet teeth 28 to fix the clamping member 40 in position on the anchoring member 20, as described below. In the preferred embodiment the clamping member 40 is provided with a pair of pawls 50 and openings 48 are provided in the body 42 allowing the pawls 50 to move freely over the teeth 28.

A resilient arm 32 projects from the front of the clip 10, in the preferred embodiment being formed integrally with the body 22 of the anchoring member 20. The arm 32 extends toward the centre of the hole 2, into the space to be occupied by the housing 6, and preferably upward into the ceiling. The arm 32 has a gripping edge 34 which engages the housing 6 of the fixture 4 to support the housing 6 by frictional engagement.

In the preferred embodiment the arm 32 is bent so that the gripping edge 34 is disposed at an oblique angle relative to the supporting panel 1, as best seen in FIG. 5. The gripping edge 34 etches into the housing 6 at a slight pitch, as shown at 36 in FIG. 10, effectively creating a threaded connection between the gripping edge 34 and the housing 6. Thus, when the fixture 4 is depressed into the hole 2 and the housing 6 is engaged by a plurality of clips 10 of the invention, rotating the housing 6 in one direction causes the fixture 4 to be drawn into the hole 2 by the pitch of the gripping edges 34.

The clip 10 is assembled by inserting the upper portion of the anchoring member 20 into the arms 46 of the clamping member 40 until the pawls 50 lock into the series of ratchet teeth 28. A clip 10 is clamped to the hole 2 in the panel 1 by placing the body 22 of the anchoring member 20 over the periphery of the hole 2 and squeezing the foot 44 of the clamping member 40 and the floor 24 of the anchoring member 20, which both slides the clamping member 40 along the body 22 of the anchoring member 20 and depresses the tooth 26 into the panel 1. An opening 23 is provided in the foot 44 through which the tooth 26 can project to accommodate thin panels 1 such as in an aluminum soffit.

As the clamping member 40 slides along the body 22 of the anchoring member 20 in the clamping direction the pawls 50 ride over and lock into the ratchet teeth 28, to prevent the clamping member 40 from sliding in the detachment direction. When the panel 1 is securely clamped between the foot 44 and the floor 24, the pawls 50 cooperate with the teeth 28 to retain the clip 10 clamped in position on the periphery of the hole 2, as shown in FIGS. 6 and 7. A plurality of clips 10, preferably three evenly distributed about the hole 2, are affixed to the supporting panel 1 in this fashion to install a fixture 4.

The fixture 4 is mounted by depressing the housing 6 into the hole 2. The resilient arms 32 flex away from the housing 6 as the gripping edges 34 scrape against the exterior wall of the housing 6. When the fixture 4 has been inserted as far as possible there will generally be a small space between the supporting panel 1 and the housing flange 8. By rotating the housing 6 in the direction in which the gripping edges 34 rise (clockwise in the embodiment shown), the housing 6 is drawn into the hole 2 by the gripping interaction between the gripping edges 34 and the wall of the housing 6, until the flange 8 seats flush against the panel 1. At the same time the resilient arms 32 are drawn toward the panel 1, compressing the arms 32 slightly and thus increasing the gripping engagement of the clips 10 on the housing 6.

The invention having been described with reference to the preferred embodiment only, it will be appreciated that certain modifications and adaptations may be made without departing from the scope of the invention as defined by the appended claims. For example, without limiting the foregoing, with suitable modifications the resilient arm 32 could depend from the clamping member 40 instead of the anchoring member 20. Also, the mechanism for clamping the clip 10 to the panel 1 could be altered without affecting the manner of mounting the fixture 4. The invention is intended to include all such modifications and adaptations as fall within the scope of the appended claims.

I claim:

1. A clip for mounting a recessed light fixture having a housing with a flange disposed about a mouth of the housing into a hole in a supporting panel, comprising an anchoring member having a floor, a clamping member slidably engaged to the anchoring member by sliding the clamping member along the anchoring member in a clamping direction, the clamping member having a foot disposed in opposition to the floor, a fixing element for fixing the clamping member to a selected position along the anchoring member, and a resilient arm extending from the clip into a space to be occupied by the housing, wherein when a clip is affixed about the hole in the panel, as the fixture is inserted into the hole the resilient arm frictionally engages against the housing to mount the fixture to the panel.

2. The mounting clip of claim 1 in which the arm includes a gripping edge disposed at an oblique angle relative to the panel, such that the gripping edge etches into the housing at a selected pitch so that when the housing is turned in the hole the gripping edge draws the flange toward the panel.

3. The mounting clip of claim 1 in which the fixing element comprises at least one pawl extending from one of the anchoring member and the clamping member cooperating with a series of ratchet teeth disposed along the other of the anchoring member and the clamping member to prevent sliding of the clamping member along the anchoring member in a direction opposite to the clamping direction.

4. The mounting clip of claim 3 in which the pawl comprises a resilient stem formed integrally with a body of the clamping member.

5. The mounting clip of claim 4 in which the ratchet teeth are disposed along a side edge of the anchoring member.

6. The mounting clip of claim 5 in which the clamping member is provided with a pair of pawls cooperating with ratchet teeth disposed along side edges of the anchoring member.

7. The mounting clip of claim 1 in which the clamping member is provided with arms which trap the anchoring member in sliding engagement.

8. The mounting clip of claim 1 in which the floor is provided with an upstanding tooth for penetrating the panel as the clip is clamped to the panel.

9. The mounting clip of claim 1 in which the resilient arm depends from the anchoring member.

10. The mounting clip of claim 1 in which the resilient arm extends from the clip at an oblique angle.

11. A clip for mounting a recessed light fixture having a cylindrical housing with a flange disposed about a mouth of the housing into a hole in a supporting panel, comprising an anchoring assembly for engaging the clip to a periphery of the hole, and a resilient arm comprising a gripping edge extending from the clip and impinging into a space to be occupied by the housing, wherein when the fixture is disposed in the hole the gripping edge frictionally engages the housing to mount the fixture into the panel, and wherein the anchoring assembly comprises a clamping member having a foot slidably engaged to an anchoring member having a floor in opposition to the foot by sliding the clamping member along the anchoring member in a clamping direction, and a fixing element for fixing the clamping member to a selected position along the anchoring member.

12. The mounting clip of claim 11 in which the gripping edge is disposed at an oblique angle relative to the panel and etches into the housing at a selected pitch so that when the housing is turned in the hole the gripping edge draws the housing into the hole and draws the flange flush against the panel.

13. The mounting clip of claim 11 in which the fixing element comprises at least one pawl extending from one of the anchoring member and the clamping member cooperating with a series of ratchet teeth disposed along the other of the anchoring member and the clamping member of ratchet teeth to prevent sliding of the clamping member along the anchoring member in a direction opposite to the clamping direction.

14. The mounting clip of claim 13 in which the pawl comprises a resilient stem formed integrally with a body of the clamping member.

15. The mounting clip of claim 14 in which the ratchet teeth are disposed along a side edge of the anchoring member.

16. The mounting clip of claim 15 in which the clamping member is provided with a pair of pawls cooperating with ratchet teeth disposed along side edges of the anchoring member.

17. The mounting clip of claim 11 in which the clamping member is provided with arms which trap the anchoring member in sliding engagement.

18. The mounting clip of claim 11 in which the floor is provided with an upstanding tooth for penetrating the panel as the clip is anchored to the panel.

19. The mounting clip of claim 11 in which the resilient arm depends from the anchoring member.

20. The mounting clip of claim 11 in which the resilient arm extends from the clip at an oblique angle.

21. In combination, a recessed light fixture having a housing with a flange disposed about a mouth of the housing, and a clip for mounting the light fixture into a hole in a supporting panel, the clip comprising an anchoring assembly for engaging the clip to a periphery of the hole and a resilient arm comprising a gripping edge extending from the clip and impinging into a space to be occupied by the housing, wherein when the fixture is disposed in the hole the gripping edge frictionally engages the housing to mount the fixture into the panel, wherein the anchoring assembly comprises a clamping member having a foot slidably engaged to an anchoring member having a clamping direction, and a fixing element for fixing the clamping member to a selected position on the anchoring member.

22. The combination of claim 21 in which the gripping edge is disposed at an oblique angle relative to the panel and etches into the housing at a selected oblique pitch so that when the housing is turned in one direction the gripping edge draws the housing into the hole and draws the flange flush against the panel.

23. The combination of claim 21 in which the fixing element comprises at least one pawl extending from one of the anchoring member and the clamping member cooperating with a series of ratchet teeth disposed along the other of the anchoring member and the clamping member to prevent sliding of the clamping member along the anchoring member in a direction opposite to the clamping direction.

24. The combination of claim 23 in which the pawl comprises a resilient stem formed integrally with a body of the clamping member.

25. The mounting clip of claim 24 in which the ratchet teeth are disposed along a side edge of the anchoring member.

26. The combination of claim 25 in which the clamping member is provided with a pair of pawls cooperating with ratchet teeth disposed along side edges of the anchoring member.

27. The combination of claim 21 in which the clamping member is provided with arms which trap the anchoring member in sliding engagement.

28. The combination of claim 21 in which the floor is provided with an upstanding tooth for penetrating the panel as the clip is clamped to the panel.

29. The combination of claim 21 in which the resilient arm depends from the anchoring member.

30. The combination of claim 21 in which the resilient arm extends from the clip at an oblique angle toward the hole and into the ceiling.

31. A clip for mounting a recessed light fixture having a housing with a flange disposed about a mouth of the housing into a hole in a supporting panel, comprising an anchoring member having a floor, a clamping member slidably engaged to the anchoring member by sliding the clamping member along the anchoring member in a clamping direction, the clamping member having a foot disposed in opposition to the floor, a fixing element for fixing the clamping member to a selected position along the anchoring member, and a resilient arm extending from the clip into a space to be occupied by the housing, wherein when a clip is affixed about the hole in the panel, as the fixture is inserted into the hole the resilient arm frictionally engages against the housing to mount the fixture to the panel, and wherein the arm includes a gripping edge disposed at an oblique angle relative to the panel, such that the gripping edge etches into the housing at a selected oblique pitch so that when the housing is turned in the hole the gripping edge draws the flange toward the panel.

* * * * *